US005604984A

United States Patent [19]

Shepherd et al.

[11] Patent Number: 5,604,984

[45] Date of Patent: Feb. 25, 1997

[54] UTILITY KNIFE WITH ROTARY BLADE MAGAZINE

[75] Inventors: Charles G. Shepherd, Oakville; Edward A. Funger, Burlington, both of Canada

[73] Assignee: The Nack Company Limited, Burlington, Canada

[21] Appl. No.: 548,941

[22] Filed: Oct. 26, 1995

[51] Int. Cl.[6] ..... B26B 1/10

[52] U.S. Cl. ..... 30/125; 30/40.2

[58] Field of Search ..... 30/125, 40, 40.2; 206/355, 356

[56] References Cited

U.S. PATENT DOCUMENTS 2,312,453 3/1943 Testi ..... 30/40.2

*Primary Examiner*—Douglas D. Watts
*Attorney, Agent, or Firm*—Rogers & Scott

[57] ABSTRACT

A utility knife has a blade magazine removably mounted in a manually holdable housing and rotatable about an axis parallel to a longitudinal axis of the housing. The blade magazine has a series of radially and longitudinally extending circumferentially spaced blade-receiving slots for separately receiving thin blades having a cutting edge at at least one end thereof, each slot having an open front end to enable a blade therein to be removed from the magazine by forward movement through the front end of the slot. The housing also carries a slidable transport mechanism having a manually engageable actuator projecting from the housing and slidable in a longitudinal direction between front and rear positions, the transport mechanism also having a blade-engaging arm within the housing. Positioning of the actuator at the forward position causes a blade carried by the arm to project from the front end of the housing in an operative position, and movement of the actuator from the forward position to the rear position causes the blade to be retracted from the operative position into the housing and into an empty slot in the magazine. The magazine is rotatable to move the retracted blade from the arm of the transport mechanism and to position a new blade from another slot onto the arm for subsequent movement by the actuator to an operative position.

15 Claims, 5 Drawing Sheets

UTILITY KNIFE WITH ROTARY BLADE MAGAZINE

Figure 1:
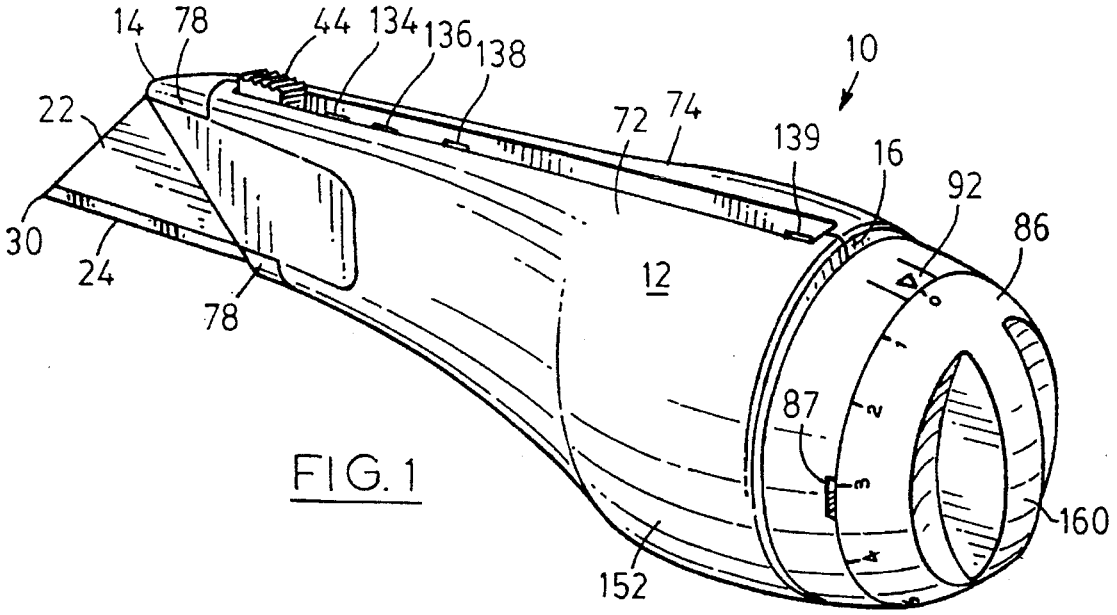

This invention related to knives, commonly known as utility knives, which have a manually holdable housing carrying a thin cutting blade which, in its operative position, projects forwardly from the housing. Most blades for such knives are double-ended, that is to say have opposite ends which are both operable as cutters so that, when one end is blunted, the blade can be reversed so that the other end forms the operative end. Such blades usually have a trapezoidal shape with a lower cutting edge which meets the inclined end edges of the blade to form acute cutting points at each end.

Utility knives are used for a variety of purposes where a hand-held tool with a sharp cutting blade is required. When a blade has been used to an extent where one or both ends is blunted, it is necessary to replace the worn blade with a new blade. With most utility knives, the old blade is manually removed from the housing and a new blade fitted. This is not only time consuming, but also involves the danger of the operator being cut by the old or the new blade. Attempts have been made to provide utility knives with a supply of new blades in the housing and a manually operable mechanism which can be operated to move a new blade into the operative position. However, for various reasons, such knives have not proved to be particularly satisfactory in practice.

It is therefore an object of the invention to provide an improved utility knife of this kind which has a supply of new blades within the housing and which can be easily operated to retract a used blade into the housing and move a new blade into the operative position.

According to the invention, a knife comprises a manually holdable housing having a front end and a rear end, and a blade magazine removably mounted in the housing and rotatable about an axis parallel to a longitudinal axis of the housing extending from the front end to the rear end. The blade magazine has a series of radially and longitudinally extending circumferentially spaced blade-receiving slots for separately receiving thin blades having a cutting edge at at least one end thereof, each slot having an open front end to enable a blade therein to be removed from the magazine by forward movement through the front end of the slot.

The housing also carries a slidable transport mechanism having a manually engageable actuator projecting from the housing and slidable in a longitudinal direction between front and rear positions. The transport mechanism also has a blade-engaging arm within the housing, whereby positioning of the actuator at the forward position causes a blade carried by the arm to project from the front end of the housing in an operative position, and movement of the actuator from the forward position to the rear position causes the blade to be retracted from the operative position into the housing and into an empty slot in the magazine. The magazine is rotatable to move the retracted blade from the arm of the transport mechanism and position a new blade from another slot onto the arm for subsequent movement by the actuator to an operative position.

The blade magazine may comprise a body rotatable about a longitudinal axis and having a front end and a rear end, the body having a series of radially and longitudinally extending circumferentially spaced blade-receiving slots for respectively receiving thin blades having a cutting edge at at least one end thereof, each slot having an open front end to enable a blade therein to be removed from the slot by forward movement through the front end of the slot.

The rotatable body may comprise first and second parts, the first part having a first end portion with a series of radially and longitudinal extending circumferentially spaced first slot-forming finger members, the first finger members extending in a longitudinal direction from the first end portion to an opposite end of the first part, and a second part having a second end portion with a series of radially and longitudinal extending circumferentially spaced second slot-forming finger members, the second finger members extending in a longitudinal direction from the second end portion to an opposite end of the second part.

The first part is assembled with the second part by longitudinal movement of the first finger members between the second finger members to provide a blade receiving slot between each adjacent pair of first and second finger members. Each slot is open at at least a front end thereof to enable a blade in the slot to be removed therefrom by the transport mechanism by longitudinal sliding movement through the front end of the slot.

The first finger members of the blade magazine may have front end portions slidably engaged over and supported by the end portion of the second part, and the second finger members may have front end portions slidably engaged over and supported by the end portion of the first part.

Each first and second finger member of the blade magazine may have a radially outer surface with a groove therein extending in a circumferential direction, the magazine also having a blade retaining ring with a circumferential gap surrounding the magazine except for the gap and seated in the grooves of the first and second fingers. The blade retaining ring is held in a non-rotatable manner in the housing with the circumferential gap aligned with the path of travel of the transport mechanism, whereby the arm of the transport mechanism can enter the circumferential gap for the unloading of a used blade from the arm and the loading of a new blade onto the arm.

Each slot of the blade magazine may contain a blade with a recess in a radially outer edge thereof, with the blade retaining ring passing through the recess of each blade.

At least one of the magazine parts may have a stub shaft projecting longitudinally outwardly from an end portion thereof, and the housing may have a manually rotatable portion receiving the stub shaft in a relatively non-rotatable manner, whereby rotation of the manually rotatable portion of the housing rotates the magazine to cause a used blade on the arm of the transport mechanism to be removed therefrom and a new blade to be attached thereto.

The housing may have a main body carrying the blade magazine and the transport mechanism, the main body being formed in two longitudinally separable portions, the housing portions having interlocking engagement adjacent the front end of the housing, and the housing also having an annular securing member surrounding the longitudinally separable housing portions adjacent the rear end of the housing to secure the laterally separable housing portions together.

The annular securing member may have a rear end cap rotatably secured thereto and relatively non-rotatably connected to the magazine, whereby manual rotation of the rear end cap rotates the magazine to cause a used blade on the arm of the transport mechanism to be removed therefrom and a new blade to be attached thereto.

The transport mechanism may also have a support surface extending forwardly and rearwardly of the arm to prevent rocking of a blade about the arm when the blade is in the operative position or when the blade is being moved between the magazine and a forward position.

Also, the housing may have a rear portion of bulbous shape carrying the blade magazine, the bulbous shape rear portion having a size for ergonomically comfortable manual holding.

Figure 9:
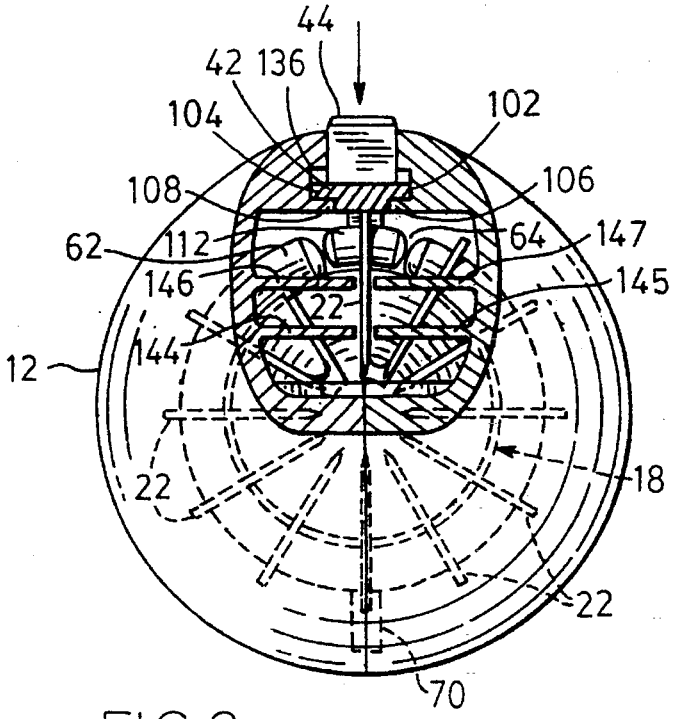
Figures 2, 3:
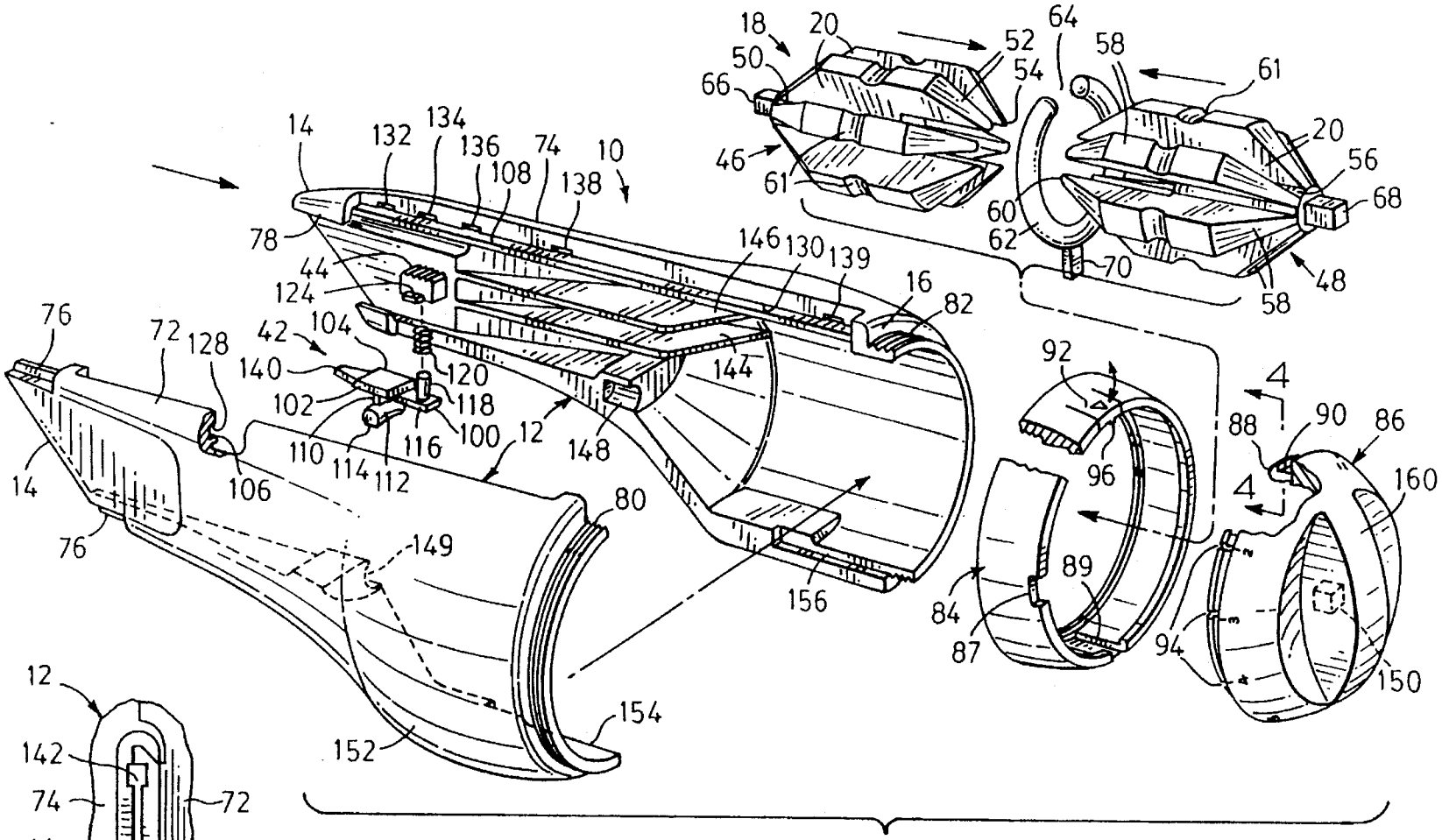
Figure 4:
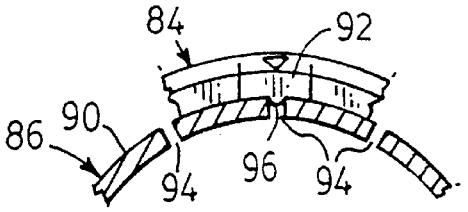
Figure 5:
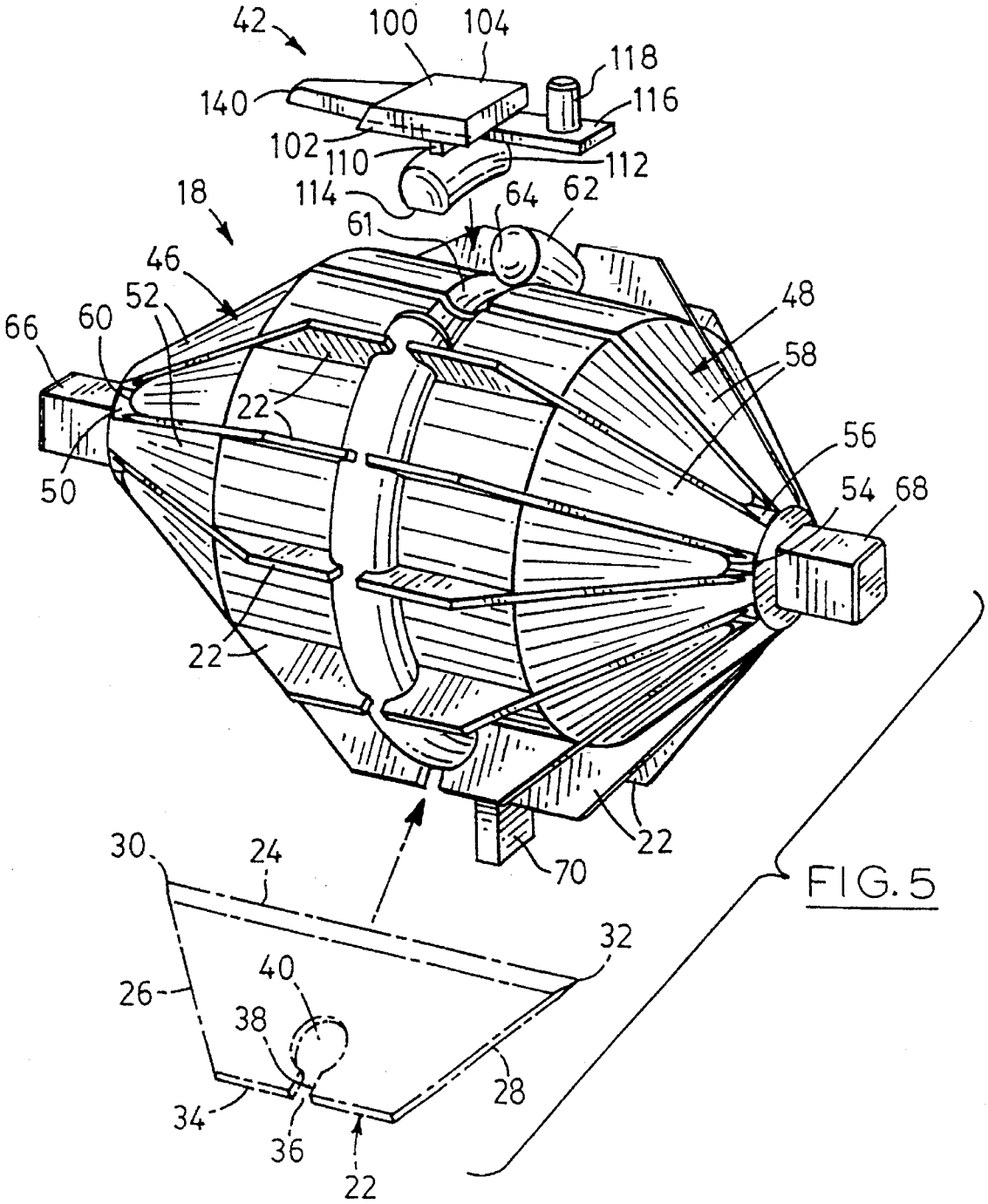
Figure 6:
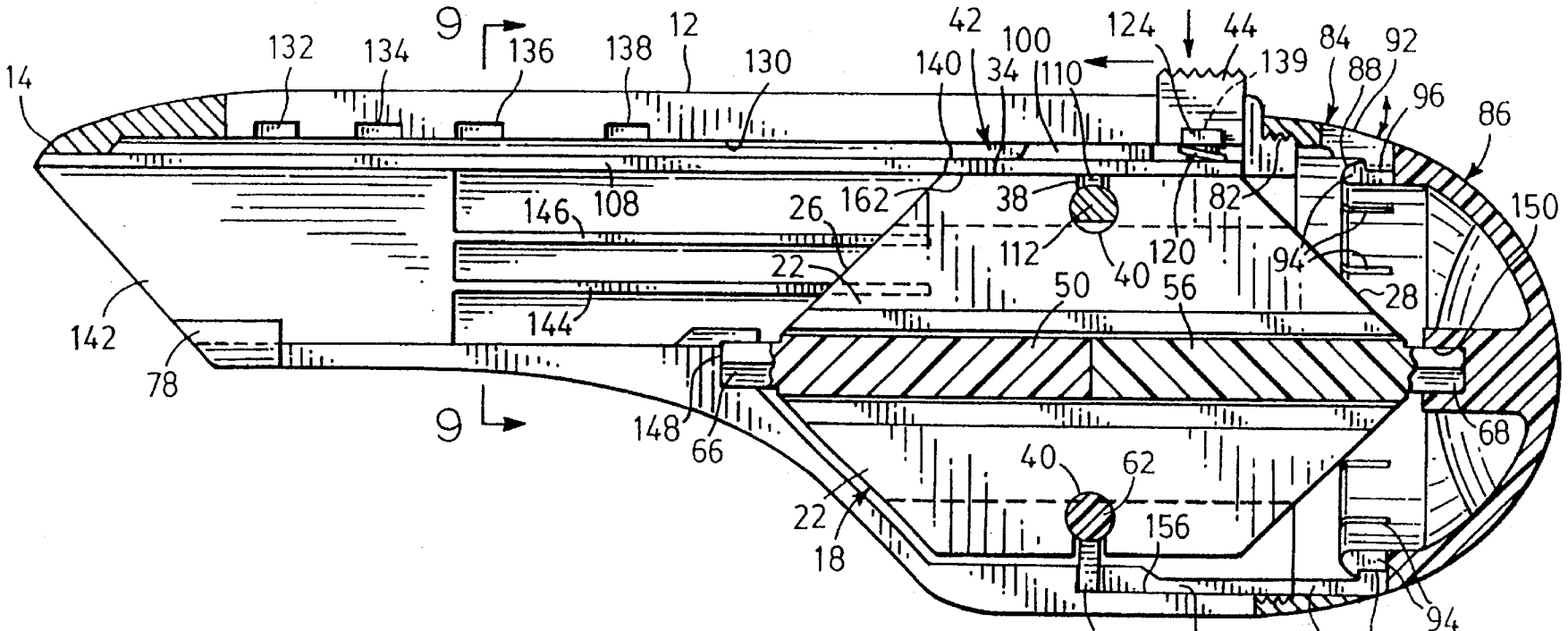
Figure 7:
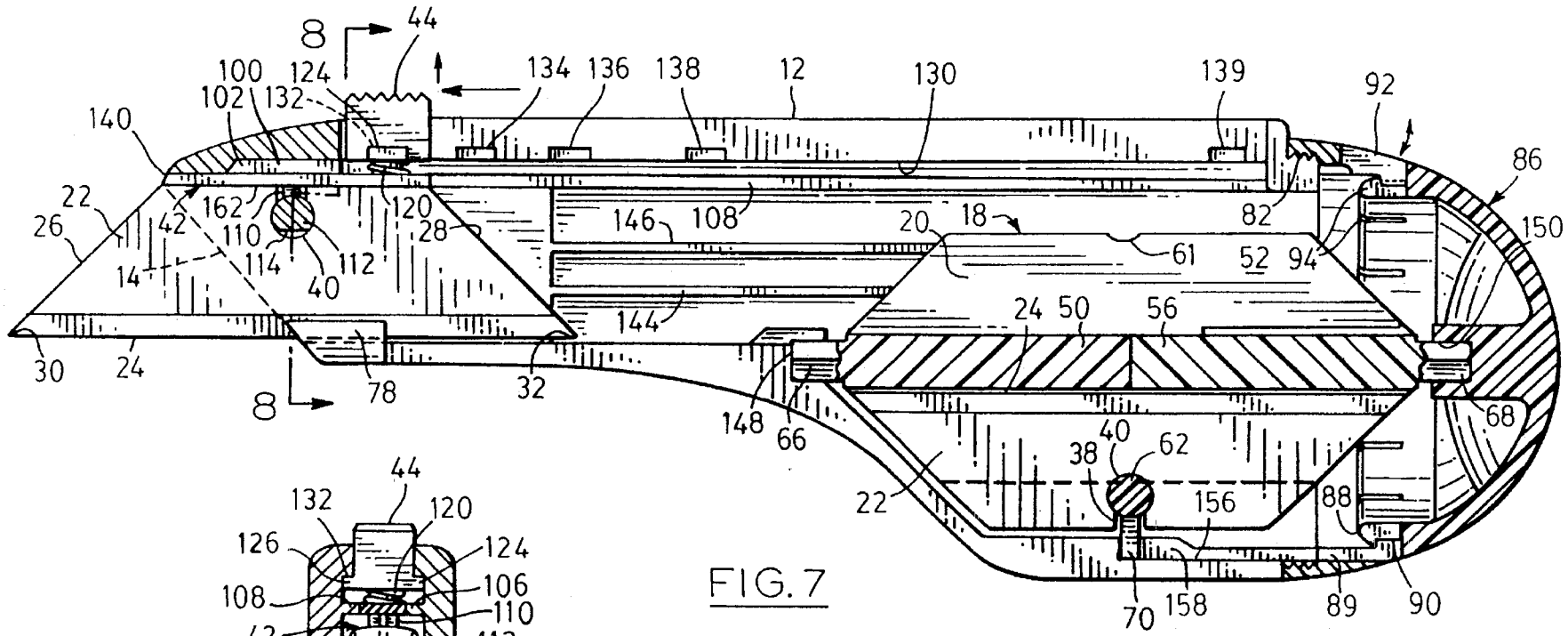
Figure 8:
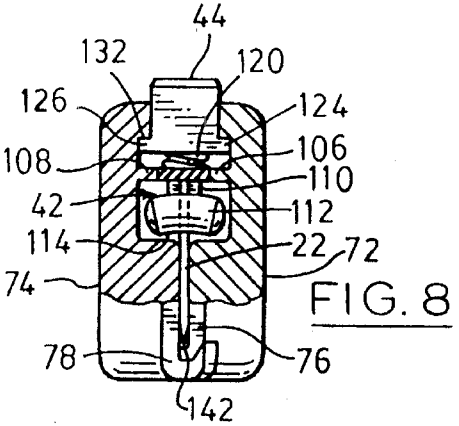

One embodiment of the invention will now be described, by way of example, with reference to the accompanying drawings, of which:

FIG. 1 is a perspective view of a utility knife in accordance with one embodiment of the invention, FIG. 2 is an exploded view of the knife of FIG. 1, FIG. 3 is a fragmentary view taken in the direction of the arrow 3 in FIG. 2 showing how the housing portions interlock adjacent the front end of the housing, FIG. 4 is a sectional view taken along the line 4—4 of FIG. 2 showing how the rear end cap co-operates with the annular securing ring at the rear end of the housing, FIG. 5 is an enlarged perspective view of the blade magazine also showing the transfer member and a blade in dotted outline for ease of explanation, FIG. 6 is a longitudinal sectional view of the knife showing a blade in the magazine engaged by the transport mechanism, FIG. 7 is a similar view showing the cutting blade moved forwardly to the operative position by the transport mechanism, FIG. 8 is a sectional view-along the line 8—8 of FIG. 7 showing the transport mechanism, and FIG. 9 is a sectional view along the line 9—9 of FIG. 6 showing the blade guide members in the housing and the transport mechanism.

Referring to the drawings, a utility knife 10 has a manually holdable housing 12 with a front end 14 and a rear end 16. A blade magazine 18 is removably mounted in the housing 12 and is rotatable fin a manner which will be described later) about an axis parallel to the longitudinal axis of the housing 12 extending from the front end 14 to the rear end 16. The blade magazine 18 has a series of radially and longitudinally extending circumferentially spaced slot 20 for separately receiving thin blades 22, these slots 20 being open at both ends. The blades 22 are of a conventional kind with a trapezoidal shape having (see especially FIG. 7) a lower cutting edge 24 which meets the inclined end edges 26, 28 to form sharp cutting points 30, 32 at each end. The upper blade edge 34 is parallel to the lower cutting edge 24. The upper edge 34 has a recess 36 midway along its length, the recess 36 having a short initial straight portion 38 with parallel sides and a circular portion 40 at the inner end of the straight portion 38.

The housing 12 also carries a slidable transport mechanism 42 which, as will also be described in more detail later, has a manually engageable actuator 44 projecting from the housing and slidable in a longitudinal direction between rear and front positions shown in FIG. 6 and 7 respectively.

The blade magazine 18 has a rotatable body with two main parts 46, 48. The first part 46 has a hub-like end portion 50 with a series of radially and longitudinal extending circumferentially spaced slot-forming finger members 52. The finger members 52 extend in a longitudinal direction from the end portion 50 to the opposite end 54 of the first part 46. The finger member 52 extend longitudinally beyond the hub-like end portion 50 and their free ends form the opposite end 54 of the first magazine part 46. The second part 48 has a hub-like end portion 56 with a series of radially and longitudinal extending circumferentially spaced second slot-forming finger members 58 which extend in a longitudinal direction from the end portion 56 to the opposite end 60 of the second part 48. The finger members 58 extend longitudinally beyond the hub-like end portion 56 and their free ends form the opposite end 60 of the second magazine part 48. The first and second finger member 52, 58 each have a groove 61 midway along their radially outer surface, the groove 61 extending in a circumferential direction.

The first magazine part 46 is assembled with the second part 48 by longitudinal movement of the first finger members 52 between the second finger members 58 to produce a blade receiving slot 20 between each adjacent pair of first and second finger members 52, 58. During assembly, the end portions of the finger members 52 of the first magazine part 46 slide over and are supported by the hub-like end portion 56 of the second magazine part 48. Similarly, the end portions of the second finger member 58 of the second magazine part 48 slide over and are supported by the hub-like end portion 50 of the first magazine part 46. When the magazine 18 is fully assembled in this manner, the hub-like end portion 50 of the first magazine part 46 abuts the hub-like end portion 56 of the second magazine part 48, as shown in FIG. 6, and the circumferentially extending groove 61 in the finger members 52, 58 form a substantially continuous circumferential groove around the magazine 18 i.e. interrupted by the slots 20, see FIG. 5.

The assembly of the magazine is completed by a blade-retaining ring 62, the ring 62 having a circumferential gap 64. The ring 62 is slid along the two assembled magazine parts 46, 48 from one end thereof until the ring 62 snaps into the circumferentially extending groove 60. The blades 22 are then loaded one at a time into the respective slots 20, with the blade-retaining ring 62 being moved around to position the gap 64 in alignment with the slot 20 into which a blade 22 is to be loaded.

As can be seen from FIG. 5, the circumferential width of the gap 64 in the blade-retaining ring 62 is equal to the spacing between the blade-receiving slots 20. A blade 22 is located in each slot 20 except one, namely the upper slot 20 in FIG. 5. The upper end of each blade 22 projects slightly above the circumferential periphery of the magazine 18 and the retaining ring 62 passes through the circular recesses 40 in each blade 22, thereby holding the blades 22 in the slots 20 with their lower cutting edges 24 slightly spaced from the hub-like end portion 50, 56 of the first and second magazine parts 46, 48.

Each hub-like end portion 50, 56 has a longitudinally projecting stub shaft 66, 68 respectively of square section, and the blade-retaining ring 62 has a radially outwardly projecting retainer 70 a position diametrically opposite the circumferential gap 64. The purpose of the stub shaft 66, 68 and the retainer 70 will be described later.

The housing 12 is formed in two longitudinally separable portions 72, 74, as most clearly shown in FIG. 2. The housing portion 72, 74 have interlocking engagement adjacent the front end 14 of the housing 12, see FIGS. 2 and 3. As shown, the interlocking engagement is provided by a tongue and groove type connection, with the housing portion 72 providing a tongue 76 and the housing portion 74 having a groove 78. To assemble the two housing portions 72, 74, the tongue 76 on the housing portion 72 is slid in to the groove 78 in the housing portion 74 from the rear end of the groove 78. Except for the tongue and groove formation 76, 78, the two housing portions 72, 74 are mirror images of each other.

The rear ends of the housing portions 72, 74 have external screw-threads 80, 82 respectively which combine to receive an internally threaded securing ring 84 which screws into engagement with the screw threads 80, 82 to secure the rear ends of the housing portions 72, 74 together.

The securing ring 84 has a rear end cap 86 rotatably secured thereto, the end cap 86 having an annular shoulder 88 which snaps in to the rear end of securing ring 84 to effect the rotatable securing of the end cap 86 to the securing ring 84.

The end cap 86 has a circumferential groove 90 rearwardly of the shoulder 88 which receives a tab 92 formed in securing ring 84. The circumferential groove 90 has detent slots 94 in its bottom surface, numbered as indicated in FIG. 2. The lower surface of the tab 92 on the securing ring 84 has a pip 96 (see FIG. 4) projecting downwardly therefrom. The pip 96 is engageable in the slots 94 in the end cap groove 90 to positively locate the end cap 86 in predetermined rotary positions relative to the securing ring 84 for a purpose which will be described later.

The transport mechanism 421 has a main body member 100 with laterally extending wing portions 102, 104 which slide along longitudinally extending ledges 106, 108 on the housing portion 72, 74 respectively. A leg 110 extends downwardly from main body member 100 and has a transversely extending arcuate blade carrier arm 112 at its lower end. The blade carrier arm 112 can move in to the gap 64 in the blade retaining ring 62, and has a similar cross-section to the ring 62 except that the lower surface 114 of the blade carrier arm 112 is flat and located at a level which positions the surface 114 above the grooves 60 in the finger members 52, 58 of the first and second magazine parts 46, 48.

The main body member 100 also has a rearward extension 116 carrying a post 118. A coil spring 120 surrounds and projects above the post 118. The lower end of the coil spring 120 is supported by the body member extension 116 and the upper end of the spring 120 carries the manually engageable actuator 44. As shown, the upper end of the spring 120 extends in to a recess 122 in the underside of actuator 44. The actuator 44 has a pair of laterally extending projections 124, 126 which normally slide beneath longitudinal extending downwardly facing shoulders 128, 130 in housing portion 72, 74 respectively for movement between forward and rear positions. The housing portion 74 has four longitudinally spaced recesses 132, 134, 136, 138, 139 extending upwardly from the shoulders 128, 130 and into each of which the actuator 44 can be pushed by the spring 120 to lock the transport mechanism 42 in any one of four predetermined positions as will be described in more detail later. The housing portion 72 has four similar recesses (not shown). The transport member 100 has a nose portion 140 at its leading end which is shaped to conform with the configuration of the front end 14 of the housing 12 when the transport member 100 is in its foremost position, and the housing portion 72, 74 form an opening 142 (see FIG. 3) to receive the nose portion 140.

The housing portion 74 has a vertically spaced pair of guide members 144, 146 which guide the blade 22 during travel to the operative position as will also be described in more detail later. The housing portion 74 has similar guide members 145, 147. The housing portion 72 also has a semi-circular recess 148 which, together with a similar recess 149 in housing portion 72, form a bearing in which the forward stub shaft 66 of the magazine 18 can rotate. The rotatable end cap 86 has a square shaped recess 150 centrally located in its inner surface to receive the rear stub shaft 68 of the magazine 18 in relatively non-rotatable relationship.

The housing portion 72, 74 have recesses 154, 156 at the rear end of their lower edges which form a slot 158 extending forwardly from the rear end 16 of housing 12 to receive the projection. 70 on blade retaining ring 62, as will be described in more detail later.

Before describing the operation of the utility knife, it should be noted that the two housing portions 72, 74 co-operate to provide a housing 12 with a rear portion 152 of bulbous shape in which the magazine 18 is located, the bulbous shape 152 having a size and shape for ergonomically comfortable holding in the hand.

To load the knife, the end cap 86 is snapped out from the housing 12 by insertion of a suitable tool in slot 87 in securing ring 84, and a loaded magazine 18 is inserted in to the rear end of housing 12 so that the front stub shaft 66 enters the bearing formed by the recesses 148, 149 in the housing portions 74, 72 respectively. It will be noted that stub shaft 66 can freely rotate therein. Projection 70 on blade retaining ring 62 enters slot 158 at the bottom of the housing 12, and is thereby prevented from rotation. Securing ring 84 has a slot 89 aligned with slot 158 to enable projection 70 to pass through the securing ring 84. End cap 86 is then snapped back into securing ring 84.

The actuator 44 is then depressed to release the projections 124, 126 from the recess 132 in the housing portion 74 and the corresponding recess in the housing portion 72 and is slid back to its rearmost position, i.e. adjacent the rear end of the housing 12, so that the blade carrier arm 112 on the transport member 100 moves in to the gap 64 in the blade retaining ring member 62, see FIG. 5. In this position, the projections 124, 126 are engaged in the rearmost recess 139 in the housing portion 74 and the corresponding recess in the housing portion 72 to lock the transport mechanism 42 in :the rearmost or "docking" position. The end cap 86 is then rotated through one "click" i.e. so that one slot 94 leaves the pip 96 on the tab 92 and the next slot 94 receives the pip 96, to rotate the-magazine 18 through one increment, i.e. to slide a blade 22 off the retaining ring 62 and onto the blade carrying arm 112, as shown in FIGS. 6 and 9. The end cap 86 is provided with a finger grip 160 to enable such rotation to be easily effected.

The actuator 44 is then slid forwardly, while being held down, to the foremost position until projections 124, 126 reach recess 132 in housing portion 174 and the corresponding recess in housing portion 72 at the forward end of the housing 12. During this movement, the transport member 100 carries the blade 22 forwardly out of its slot 20 and to the operative position shown in FIG. 7, where the front part of the blade 22 projects from the front end of the housing 12. During the forward movement, the blade 22 is guided by the guide members 144, 146 and 145, 147. If less projection of the blade 22 is desired, the actuator 44 may be engaged in one of two more rearwardly positions defined by recesses 136, 138 in housing portion 74 and the corresponding recesses in housing portions 72. If it is wished to temporarily retract the blade 22, the actuator 44 is moved back to recess 138 in housing portion 74 and the corresponding recess in housing portion 72. It will be noted that the blade 22 is prevented from rocking by engagement of its upper edge 34 with the lower surface 162 of a transport member 100, see FIGS. 6 and 7.

To change the blade 22, for example when its forward end is blunt, the actuator 46 is slid back to the rearmost position so that the blunt blade 22 is returned to its original slot 20. The magazine 18 is then rotated through a further increment rotation of the end cap 86 to the next number shown thereon, thereby causing the blunt blade 22 to be moved off blade carrier arm 112 and onto blade retaining member 62. At the same time, a new blade 22 is moved on to the blade carrier arm 112 and can be moved to the operative position by depression and forward movement of the actuator 44.

When all the blades 22 in the magazine 18 have been used, i.e. the magazine 18 has been rotated through 360°, the magazine 18 can be taken out of the housing 12 and reversed so that the other ends of the blades 22 can then be used. It is of course for this reason that slots 20 are open at both ends. After that, a new magazine 18 is used.

The advantages of the invention will be readily apparent from the foregoing description of a preferred embodiment. Other embodiments of the invention will also be readily apparent to a person skilled in the art, the scope of the invention being defined in the appended claims.

We claim:

1. A knife comprising:

a manually holdable housing having a front end and a rear end, a blade magazine removably mounted in the housing and rotatable about an axis parallel to a longitudinal axis of the housing extending from the front end to the rear end, said blade magazine having a series of radially and longitudinally extending circumferentially spaced blade-receiving slots for separately receiving thin blades having a cutting edge at at least one end thereof, each slot having an open front end to enable a blade therein to be removed from the magazine by forward movement through the front end of the slot, said housing also carrying a slidable transport mechanism having a manually engageable actuator projecting from the housing and slidable in a longitudinal direction between front and rear positions, said transport mechanism also having a blade-engaging arm within the housing, whereby positioning of the actuator at the forward position causes a blade carried by the arm to project from the front end of the housing in an operative position, and movement of the actuator from the forward position to the rear position causes the blade to be retracted from the operative position into the housing and into an empty slot in the magazine, said magazine being rotatable to move said retracted blade from the arm of the transport mechanism and to position a new blade from another slot onto the arm for subsequent movement by the actuator to an operative position.

2. A knife according to claim 1 wherein the blade magazine comprises:

a first part having a first end portion with a series of radially and longitudinally extending circumferentially spaced first slot-forming finger members, said first finger members extending in a longitudinal direction from said first end portion to an opposite end of said first part, and a second part having a second end portion with a series of radially and longitudinally extending circumferentially spaced second slot-forming finger members, said second finger members extending in a longitudinal direction from said second end portion to an opposite end of said second part, said first part having been assembled with said second part by longitudinal movement of the first finger members between the second finger members to provide a blade receiving slot between each adjacent pair of first and second finger members, each slot being open at at least a front end thereof to enable blade in the slot to be removed therefrom by the transport mechanism by longitudinal sliding movement through said front end of the slot.

3. A knife according to claim 2 wherein the first finger members of the blade magazine have front end portions slidably engaged over and supported by the end portion of the second part, and the second finger members have front end portions slidably engaged over and supported by the end portion of the first part.

4. A knife according to claim 2 wherein each first and second finger member of the blade magazine has a radially outer surface with a groove therein extending in a circumferential direction, said magazine also having a blade retaining ring with a circumferential gap surrounding the magazine except for the gap and seated in the grooves of the first and second fingers, said blade retaining ring being held in a non-rotatable manner in the housing with the circumferential gap aligned with the path of travel of the transport mechanism, whereby the arm of the transport mechanism can enter the circumferential gap for unloading of a used blade from the arm and the loading of a new blade on to the arm.

5. A knife according to claim 4 wherein each slot of the blade magazine contains a blade with a recess in a radially edge thereof, and said blade retaining ring passes through the recess of each blade.

6. A knife according to claim 2 wherein at least one of the magazine parts has a stub shaft projecting longitudinally outwardly from an end portion thereof, and said housing has a manually rotatable portion receiving the stub shaft in a relatively non-rotatable manner, whereby rotation of the manually rotatable portion of the housing rotates the magazine to cause a used blade on the arm of the transport mechanism to be removed therefrom and a new blade to be attached thereto.

7. A knife according to claim 1 wherein the housing has a main body carrying the blade magazine and the transport mechanism, said main body being formed in two longitudinally separable portions, said housing portions having interlocking engagement adjacent the front end of the housing, and said housing also having an annular securing member surrounding the longitudinally separable housing portions adjacent the rear end of the housing to secure said laterally separable housing portions together.

8. A knife according to claim 7 wherein the annular securing member has a rear end cap rotatably secured thereto and relatively non-rotatably connected to the magazine, whereby manual rotation of the rear end cap rotates the magazine to cause a used blade on the arm of the transport mechanism to be removed therefrom and a new blade to be attached thereto.

9. A knife according to claim 1 wherein the transport mechanism also has a blade support surface extending forwardly and rearwardly of the arm to prevent rocking of a blade about the arm when the blade is in the operative position or when the blade is being moved between the magazine and a forward position.

10. A knife according to claim 1 wherein said housing has a rear portion of bulbous shape carrying the blade magazine, said bulbous shape rear portion having a size for ergonomically comfortable holding.

11. A blade magazine comprising:

a body rotatable about a longitudinal axis and having a front end and a rear end, the body having a series of radially and longitudinally extending circumferentially spaced blade-receiving slots for respectively receiving thin blades having a cutting edge at at least one end thereof, each slot having an open front end to enable a blade therein to be removed from the slot by forward movement through the front end of the slot, the first part having a first end portion with a series of radially and longitudinally extending circumferentially spaced first slot-forming finger member, said finger members extending in a longitudinal direction from said first end portion to an opposite end of said first part, and the second part having a second end portion with a series of radially and longitudinally extending circumferentially spaced second slot-forming finger members, said second finger members extending in a longitudinal direction from said second end portion to an opposite end of said second part, said first part having been assembled with said second part by longitudinal movement of the first finger members between the second finger members to provide a blade receiving slot between each adjacent pair of first and second finger members, said slot being open at at least one end to enable a blade in the slot to be removed therefrom through the open end thereof.

12. A blade magazine according to claim 11 wherein the first finger members have first end portions slidably engaged over and supported by the end portion of the second part, and the second finger members have first end portions slidably engaged over and supported by the end portion of the first part.

13. A blade magazine according to claim 11 wherein each first and second finger member has a radially outer surface with a groove therein extending in a circumferential direction, said magazine also having a blade retaining ring with a circumferential gap surrounding the magazine except for the gap and seated in the grooves of the first and second fingers.

14. A blade magazine according to claim 13 wherein each slot contains a blade with a recess in a radially outer edge thereof, and said blade retaining ring passes through the recess of each blade.

15. A blade magazine according to claim 11 wherein at least one of the magazine parts has a stub shaft projecting longitudinally outwardly from the end portion thereof.

* * * * *